US006126064A

United States Patent [19]

Hutchinson

[11] Patent Number: 6,126,064

[45] Date of Patent: Oct. 3, 2000

[54] SECURE SEAL SECTOR

[75] Inventor: Wilbur Hutchinson, St. George, Utah

[73] Assignee: Moore U.S.A. Inc., Grand Island, N.Y.

[21] Appl. No.: 09/238,176

[22] Filed: Jan. 28, 1999

[51] Int. Cl.[7] ..... B65D 27/34

[52] U.S. Cl. ..... 229/92.1; 229/313; 283/105

[58] Field of Search ..... 229/92.1, 92.3, 229/313; 283/101, 105, 106

[56] References Cited

U.S. PATENT DOCUMENTS

| | | | |
|---|---|---|---|
| 1,794,223 | 2/1931 | Zabek | 229/92.1 |
| 2,408,626 | 10/1946 | Green | 283/105 X |
| 2,967,657 | 1/1961 | Kushner . | |
| 3,229,893 | 1/1966 | Stein . | |
| 3,863,835 | 2/1975 | Gendron . | |
| 3,979,051 | 9/1976 | Close . | |
| 4,428,526 | 1/1984 | Riley . | |
| 4,660,856 | 4/1987 | Shacklett, Jr. . | |
| 4,896,823 | 1/1990 | Taylor . | |
| 4,928,875 | 5/1990 | Hutchinson . | |
| 5,201,464 | 4/1993 | File . | |
| 5,253,898 | 10/1993 | Mangione . | |
| 5,288,015 | 2/1994 | Sauerwine . | |
| 5,290,225 | 3/1994 | Younger . | |
| 5,366,145 | 11/1994 | Sauerwine . | |
| 5,375,764 | 12/1994 | Sauerwine . | |
| 5,427,416 | 6/1995 | Birch | 283/103 X |
| 5,553,774 | 9/1996 | Goodno . | |

FOREIGN PATENT DOCUMENTS

| | | | |
|---|---|---|---|
| 326074 | 5/1903 | France . | |
| 67753 | 8/1892 | Germany | 229/92.1 |
| 3511529 | 10/1986 | Germany | 229/92.7 |
| 11831 | of 1901 | United Kingdom . | |
| 92/22431 | 12/1992 | WIPO | 283/105 |

*Primary Examiner*—Jes F. Pascua
*Attorney, Agent, or Firm*—Nixon & Vanderhye P.C.

[57] ABSTRACT

An intermediate for a mailer type business form, and a mailer produced from it, allow construction, from a single sheet of paper, of a mailer type business form that has a confidential integral insert closed on all edges. Confidential indicia is imaged on the interior faces of the insert, and is accessible only by tearing along at least one edge of the insert, which indicates tampering. Double fold, roll fold, or other folds may be provided for forming the mailer from the intermediate. For double fold and roll fold constructions, no security screening is necessary, yet the confidential indicia is substantially as secure as if security screening had been provided.

23 Claims, 7 Drawing Sheets

10

20
35
13
34
19
CONFIDENTIAL
INSERT
33
24
32
21
41
29
42
28
25
52
12
22
53
18
17
27
23
15
29
28
18
26
16
54
14
50

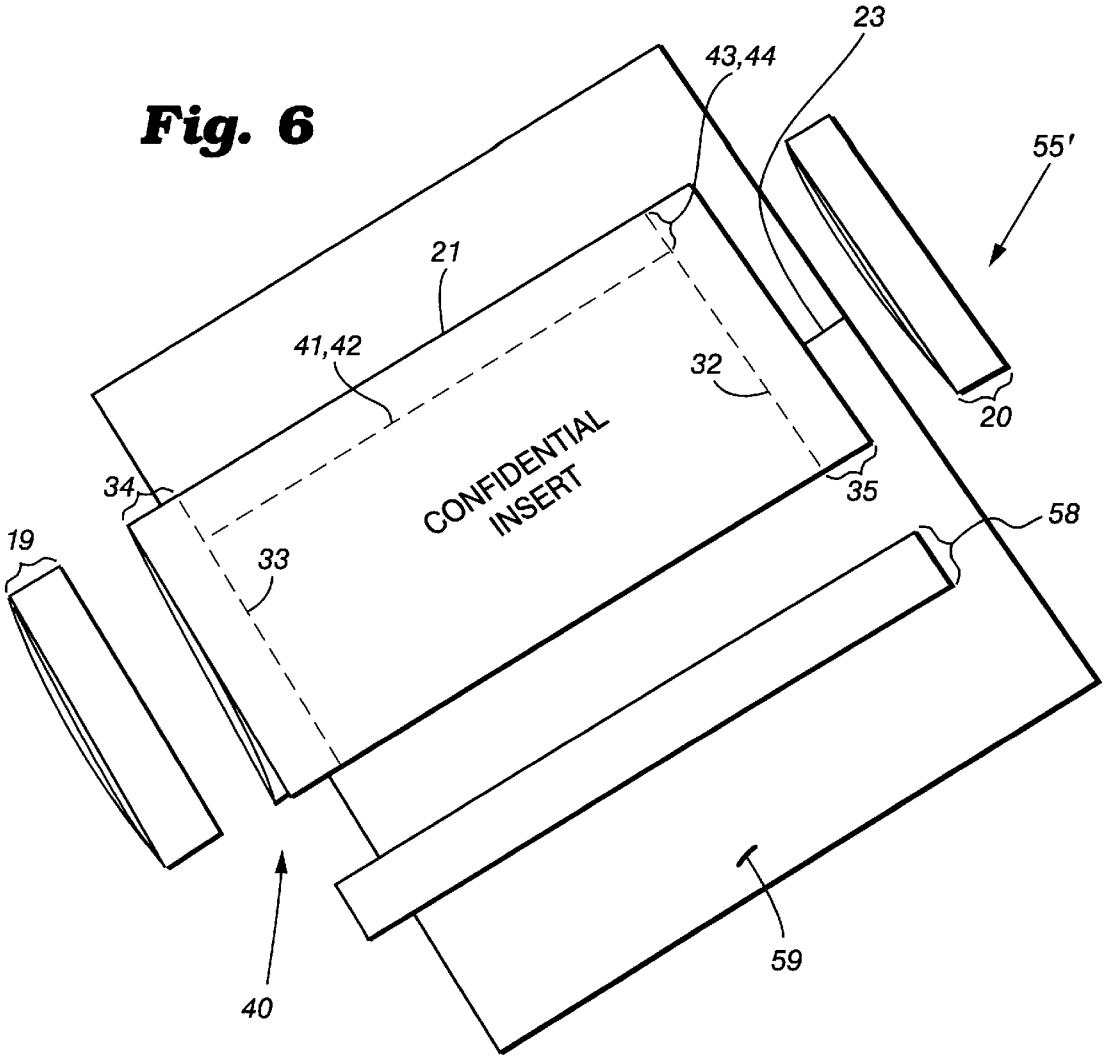
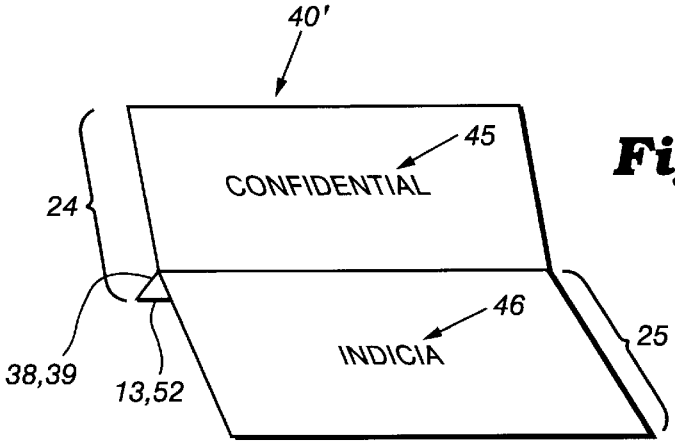
Fig. 7

SECURE SEAL SECTOR

BACKGROUND AND SUMMARY OF THE INVENTION

There are many circumstances in which it is desirable to transmit highly confidential information (such as personal identification numbers, "PIN"), but it is desirable to do that in a simple and effective manner. While mailer type business forms are normally the simplest and least expensive type of mailable business form, conventional self-mailers, as well as enclosed or inserted mail, can often be carefully opened and resealed without evidence of tampering, and typically security screening printing is necessary on two plies of the mailer to get the needed level of confidentiality.

According to the present invention an intermediate for a mailer type business form, and a mailer type business form formed from the intermediate, are produced which are advantageous compared to conventional constructions in the transmission of highly confidential information. According to the present invention a mailer without inserts, that is made essentially from a single sheet of paper, may be constructed without any, or minimal, security screening, yet provide a high level of confidentiality, while readily indicating tampering. According to the invention a confidential integral (that is formed of the same sheet of paper making up the rest of the mailer) insert is provided which is closed on all edges thereof, and indicates tampering if opened along one of the edges.

The mailer according to the invention is distinct from conventional mailers that include reply envelopes, such as shown in U.S. Pat. Nos. 5,375,764 and 5,553,774, because the integral insert in the form of a reply envelope that is provided in such constructions is sealed only on three edges. The fourth edge must remain open to allow the insertion of a check, return stub, or the like, and only after that is inserted is the reply envelope sealed by special activation of a reply envelope flap. Thus, the purpose of the integral insert according to the invention is much different than for conventional mailer type business forms with integral reply envelopes, the intermediate and business form according to the invention having confidential indicia imaged within the integral insert, whereas, of course, indicia is not typically imaged inside of a reply envelope because it is never seen.

The mailer according to the present invention is preferably made from an intermediate having four panels, and by either double folding (the preferred construction, such as generally seen in FIG. 3 of the U.S. Pat. No. 5,375,764 patent), or roll folding, of the mailer panels. However, in many circumstances, especially where security screening of just one panel is cost justified or acceptable, the mailer according to the invention can be made from a four panel intermediate by combining C or Z folding.

According to one aspect of the present invention an intermediate for a mailer type business form is provided comprising the following components: A substantially quadrate sheet of paper having first and second faces, substantially parallel first and second end edges, and first and second side edges substantially parallel to each other and substantially perpendicular to the end edges. First and second lines of weakness formed in the sheet of paper adjacent and substantially parallel to the first and second side edges, respectively, and defining first and second, respectively, tear-off strips. At least first and second fold lines substantially parallel to the end edges and defining the sheet into at least first, second and third panels, the first panel between the first end edge and first fold line, the second panel between the first and second fold lines, and the third panel on the opposite side of the second fold line from the second panel. First adhesive or cohesive patterns in the first and second tear-off strips for sealing the panels together when the sheet is folded about the first and second fold lines. Third and fourth lines of weakness, substantially parallel to the first and second lines of weakness, provided in the first and second panels between the first and second lines of weakness, and defining third and fourth, respectively, tear off strips. Second adhesive or cohesive patterns on the first face in the third and fourth tear-off strips for sealing the first and second panels together when the sheet is folded about the first fold line. And a third adhesive or cohesive pattern provided on the first face in at least one of the first panel adjacent the first end edge and the second panel near the second fold line to cooperate with the second adhesive or cohesive patterns and the first fold line to define, when the first and second panels are folded about the first fold line with the first faces thereof in contact with each other and the second and third adhesive or cohesive patterns sealed, a confidential integral insert closed on all edges thereof.

The intermediate further comprises confidential indicia imaged on the first face of at least one of (e.g. or both) of the first and second panels. Outgoing address indicia is also preferably imaged on the first or second face of the third panel. The lines of weakness may comprise perforation lines, die cut lines, or any other conventional lines of weakness. The adhesive or cohesive may comprise any type of conventional adhesive (such as heat activated, or rewettable), but preferably comprises pressure activated cohesive such as a styrene-natural rubber copolymer composition as in U.S. Pat. Nos. 4,918,128 and 5,427,851. Various other forms that the pressure sensitive cohesive may take, including commercial formulations thereof, are disclosed in U.S. Pat. No. 5,201,464 (the disclosure of which is hereby incorporated by reference herein). When pressure sensitive cohesive is used, the equipment for sealing is preferably conventional Moore U.S.A., Inc. (Lake Forest, Ill.) SpeediSealer® pressure seal equipment which typically applies a pressure of about 100–200 pounds per lineal inch to the cohesive to secure the intermediate panels together.

The sheet of paper may be a standard legal size (14 inch or 13 inch length), or A4 size sheet. The second fold line may be a line of weakness, and the third panel, and at least one of the first and second panels, is preferably is substantially devoid of security screening. Outgoing address indicia is typically provided on the third panel.

In a preferred embodiment, the at least first and second fold lines comprises first, second, and third fold lines; and the at least three panels comprises first, second, third and fourth panels, the third panel between the third fold line and the second end edge, and the fourth panel between the second and third fold lines; and when the panels are folded about the first, second and third fold lines, the first and second panels are between the third and fourth panels. All the panels may be substantially devoid of security screening. Outgoing address indicia may be on the first face of the third panel. The intermediate may further comprise a fourth adhesive or cohesive pattern provided on the least one of the second face of the third panel adjacent the second end edge, and the first face of the second panel adjacent the second fold line; and may also further comprise fifth and sixth lines of weakness substantially parallel to and adjacent and on opposite sides of the first fold line, extending between the third and fourth lines of weakness, and defining fifth and sixth, respectively, tear off strips. Still further, the intermediate may further comprise seventh, eighth and ninth lines of weakness formed in the second, third, and fourth panels, respectively, substantially parallel to the end edges, the seventh and eighth lines of weakness adjacent the second fold line, and the ninth line of weakness adjacent the second end edge; to define seventh, eighth and ninth tear off strips, the fourth adhesive or cohesive provided in at least one of the ninth and seventh tear-off strips.

The mailer intermediate also preferably further comprises at least one other pattern of adhesive or cohesive holding the panels together when the sheet is double folded about the second fold line, and then together the first and third fold lines. In another embodiment the mailer intermediate may further comprise at least one other pattern of adhesive or cohesive holding the panels together when roll folded about the first fold line, then the second fold line, and then the third fold line, in the same direction.

The invention also relates to a mailer type business form made by double folding the four panel intermediate described above, and sealing the adhesive or adhesive patterns thereof. Alternatively, the mailer type business form may be made by roll folding the four panel intermediate described above and sealing the adhesive or cohesive patterns thereof. Three panel intermediates may be C or Z-folded to form a mailer, and the adhesive or cohesive patterns are sealed.

According to another aspect of the present invention a mailer type business form is provided consisting essentially of (or comprising): A single sheet of paper and having a top ply, bottom ply, and two intermediate plies, each ply with first and second side edges, and first and second end edges, and the intermediate plies including facing interior faces; and further comprising: First, second, and third lines of weakness formed in the plies adjacent at least three of the side and end edges and defining tear-off strips. First adhesive or cohesive patterns holding the plies together in the tear-off strips. Second adhesive or cohesive patterns holding the intermediate plies together so as to define a confidential integral insert closed on all edges thereof. Confidential indicia imaged on at least one of the interior faces of the intermediate plies. And other lines of weakness formed in the intermediate plies, confidential integral insert, to allow ready and tamper-indicating opening of the confidential integral insert to expose the confidential indicia. The mailer may also further comprise outgoing address indicia imaged on the top ply and visible from the exterior of the mailer, and the first and second patterns of adhesive or cohesive may comprise pressure activated cohesive.

It is the primary object of the present invention to provide an intermediate for a mailer type business form, and a business form produced from the intermediate, which is simple and easy to manufacture, and provides a high level of security for confidential information contained therein, as well as providing a tampering indication. This and other objects of the invention will become clear from an inspection of a detailed description of the invention and from the appended claims.

BRIEF DESCRIPTION OF THE DRAWINGS

FIG. 6 is a top perspective view showing the mailer of FIG. 5 after removal of the security portions thereof, revealing the confidential integral insert therewithin;

FIG. 7 is a top perspective view showing the confidential insert of FIG. 6 after it has been opened up;

DETAILED DESCRIPTION OF THE DRAWINGS

Figure 1:
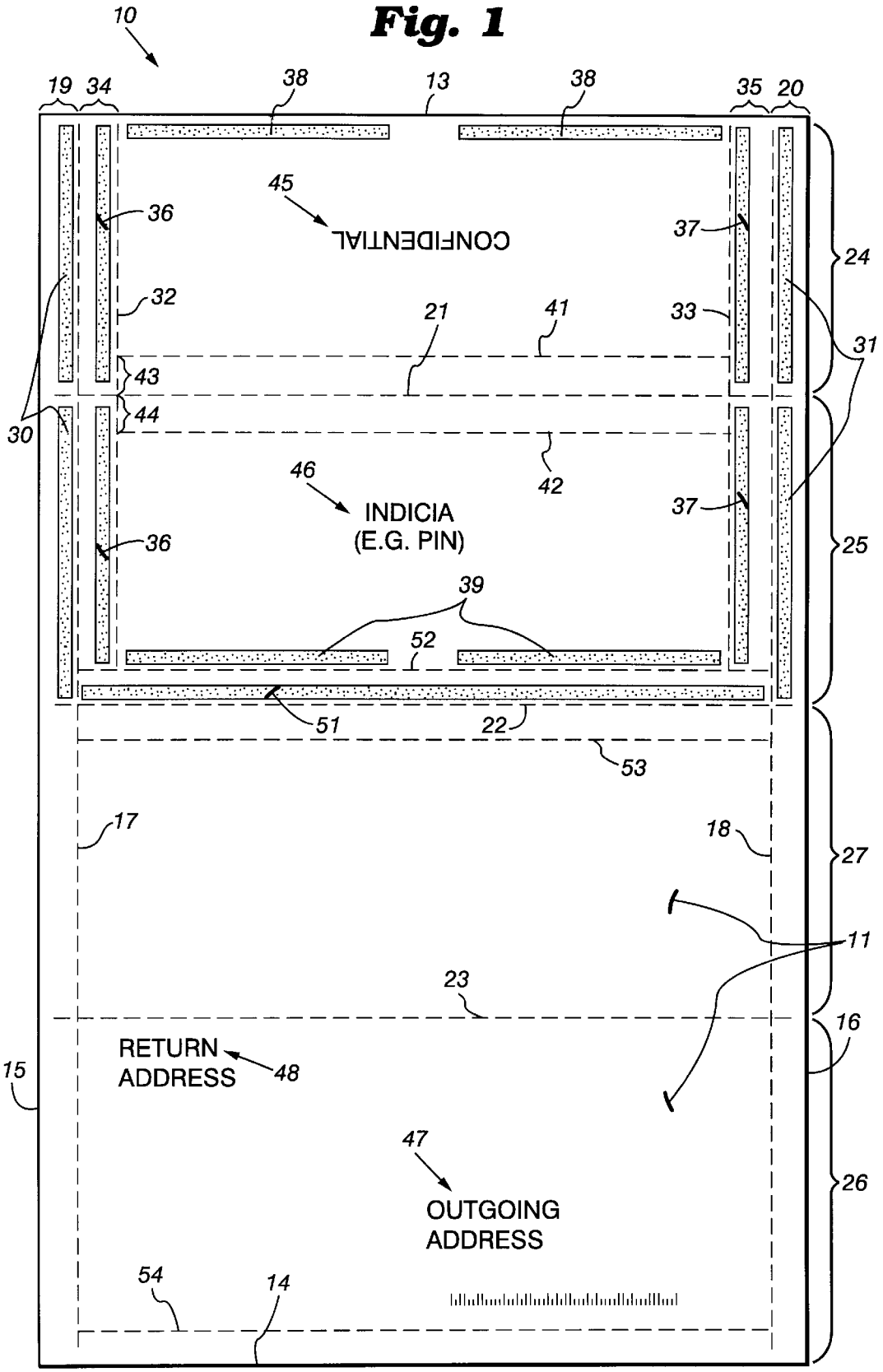
FIG. 1 is a top plan view of a first face of one embodiment of an intermediate for a mailer type business form according to the present invention.
Figure 2:
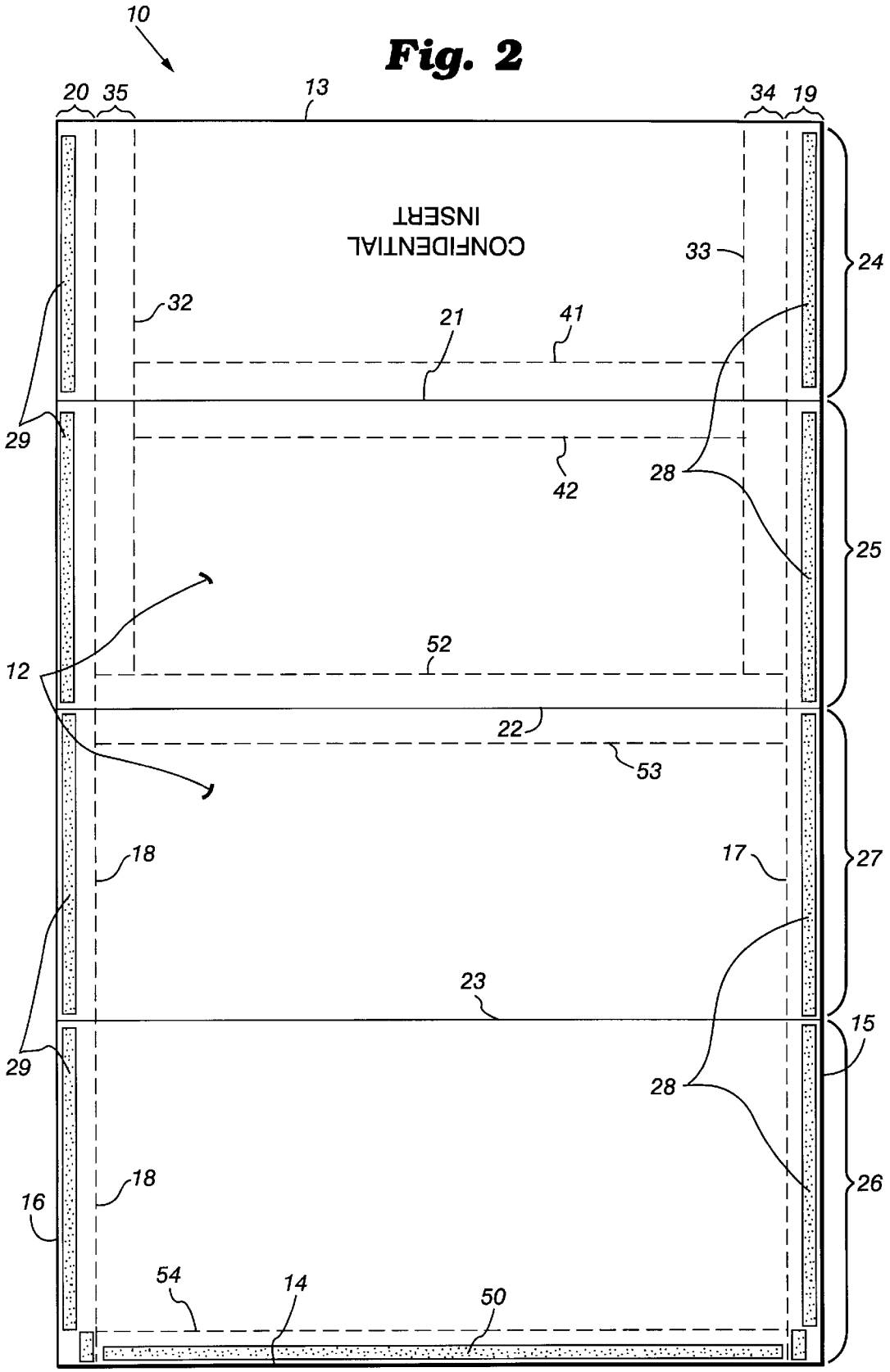
FIG. 2 is a bottom plan view of the intermediate of FIG. 1.

FIGS. 1 and 2 illustrate plan views of opposite faces of one form of an intermediate 10 for a mailer type business form according to the present invention. The intermediate 10 is made from a substantially quadrate (square or rectangular, preferably rectangular) sheet of paper (e.g. standard legal size, either of 13 or 14 inch length, or standard A4 size) having a first face 11 (FIG. 1) and a second face 12 (FIG. 2), first and second end edges 13, 14, respectively, substantially parallel to each other, and first and second side edges 15, 16, respectively, substantially parallel to each other and substantially perpendicular to the end edges 13, 14. The intermediate 10 also comprises first and second lines of weakness 17, 18 formed in the sheet and adjacent and substantially parallel to the first and second side edges 15, 16, respectively, and defining first and second, respectively, tear-off strips 19, 20. The lines of weakness 17, 18 may be any conventional lines of weakness such as perforations (including micro perforations), die cuts, or the like. The end edge 13 could be defined by a fold line.

The intermediate 10 further comprises at least first and second fold lines 21, 22, and in the preferred embodiment illustrated in FIGS. 1 and 2 a third fold line 23. The fold lines 21–23 are substantially parallel to each other and to the end edges 13, 14, and define the intermediate 10 into panels. Between the end edge 13 and the first fold line 21 is a first panel 24, between the first and second fold lines 21, 22 is a second panel 25, and at least a third panel is provided on the opposite side of the second fold line 22 from the second panel 25. In the preferred embodiment illustrated in FIG. 1 the third panel 26 is between the third fold line 23 and the end edge 14, while the fourth panel 27 is between the second and third fold lines 22, 23.

The intermediate 10 further comprises first adhesive or cohesive patterns formed in the tear-off strips 19, 20 for sealing the panels 24–27 together when the sheet 10 is folded about the fold lines (e.g. 21, 22). The adhesive or cohesive used here, and wherever else described below, is preferably all of the same type. For example, all of the adhesive or cohesive patterns may comprise heat sealable or water activated adhesive. In the preferred embodiment, however, pressure activated cohesive such as described above, and in U.S. Pat. No. 5,201,464, is utilized. Cohesive patterns are illustrated in the drawings. However, it is to be understood that if adhesive is used instead, typically one of the mating patterns of cohesive illustrated in the drawings is simply eliminated and the adhesive acts between portions of the paper defining the intermediate 10 alone. The patterns may be spots (of any shape, such as polygonal, circular, or even irregular), strips, or the like. In the embodiments illustrated in the drawings the patterns are all illustrated as strips, but it is to be understood that other conventional adhesive or cohesive patterns, as described above may be utilized.

In the exemplary embodiment illustrated in FIGS. 1 and 2, the first cohesive pattern comprises the strips 28 provided in the first tear-off strip 19 and the strips 29 provided in the second tear-off strip 20. When the intermediate 10 of FIGS. 1 and 2 is made into a mailer by double folding first about a second fold line 22, and then substantially simultaneously about the first and third fold lines 21, 23, the strips 28 in the panels 24, 26 come into contact with each other, the strips 29 in the panels 24, 26, come into contact with each other, while the strips 28, 29, in the panels 25, 27, respectively, come into contact each other. The first pattern may also comprise the adhesive strips 30, 31 in the tear-off strips 19, 20, respectively, of the panels 24, 25 on the first face 11 thereof. If the strips 30, 31 are utilized, they come into contact with each other when the intermediate 10 is folded about the fold line 21, then it is preferred that they be spaced in the direction of elongation of the edge 13 from the strips 28, 29. For example, by comparing FIGS. 1 and 2 it will be seen that the strips 30, 31 are immediately adjacent the lines of weakness 17, 18, while the strips 28, 29 are close to the edges 15, 16, respectively, so that, for example, the strips 30 and 28 do not overlap in the dimension of the end edge 13.

The intermediate 10 further comprises third and fourth lines of weakness 32, 33, respectively, substantially parallel to the first and second lines of weakness 17, 18, and provided in the first and second panels 24, 25 between the first and second lines of weakness 17, 18, and defining third and fourth, respectively, tear-off strips 34, 35.

The intermediate 10 further comprises second adhesive or cohesive patterns (cohesive being illustrated) on the first face 11 in the third and fourth tear-off strips 34, 35 for sealing the first and second panels 24, 25 together when the sheet 10 is folded about the first fold line 21. The second cohesive patterns in the embodiment illustrated in FIG. 1 are provided by the cohesive strips 36, 37 in the tear-off strips 34, 35, respectively, the strips 36 coming into contact with each other and the strips 37 into contact with each other, when the intermediate 10 is folded about the fold line 21.

The intermediate 10 further comprises a third adhesive or cohesive pattern (cohesive being illustrated in the drawings) provided on the first face 11 in at least one of the first panel 24 adjacent the first end edge 13, and the second panel 25 adjacent the second fold line 22. In the embodiment of FIG. 1 the third cohesive pattern comprises the strips 38 adjacent and substantially parallel to the first end edge 13, the strip 39 near but spaced from and substantially parallel to the second fold line 22. The strips 38, 39 mate with each other when the sheet 10 is folded about the first fold line 21.

The cohesive strips 36–39, together with the sheet of paper 10 itself at the first fold line 21, define, when the panels 24, 25 are folded about the fold line 21 so that the faces 11 thereof come into contact with each other, a confidential insert integral with (that is part of) the sheet 10, closed on all edges thereof, being formed. The confidential insert is illustrated generally at reference numeral 40 in FIG. 6.

The intermediate 10 (and the confidential insert 40) also comprise, in the preferred embodiment illustrated in FIG. 1, fifth and sixth lines of weakness 41, 42 substantially parallel to and adjacent in opposite sides of the first fold line 21 extending between the third and fourth lines of weakness 32, 33 and defining fifth and sixth tear-off strips 43, 44. If desired cohesive or adhesive may be provided on the first face 11 of the intermediate 10 within the strips 43, 44 to provide an actual adhesive/cohesive sealing along all four edges of the insert 40, and other lines of weakness adjacent the cohesive strips 38, 39, and on opposite sides of the end edge 13 and second fold line 22, respectively, thereof, could also be provided.

The intermediate 10 further comprises confidential indicia, such as illustrated schematically by reference numerals 45, 46 in FIGS. 1 and 7, imaged on the first face 11 of at least one of the first and second panels 24, 25. The confidential indicia 45, 46 may be, for example, a PIN, and instructions for use, account information, etc.

The intermediate 10 further comprises outgoing address indicia imaged on the third panel 26. For example, in the embodiment illustrated in FIGS. 1 through 5, the outgoing address indicia 47 is imaged on the first face 11 of the third panel 26. Return address indicia 48 may also be imaged on the same face of the third panel 26. If roll folding of the intermediate 10 is practiced, the outgoing address indicia 47 could be imaged on the second panel 27 and a window provided in the third panel 26 for cooperation with the outgoing address indicia. A wide variety of other indicia may also be provided on other panel faces of the intermediate 10 depending upon the needs in a particular situation.

In the construction of the intermediate of FIGS. 1 through 4, there is no need for security screening because the panels 26, 27 provide effective security screening for the confidential insert 40 during mailing. Therefore, the intermediate 10 may be substantially devoid of security screening.

Figure 3:
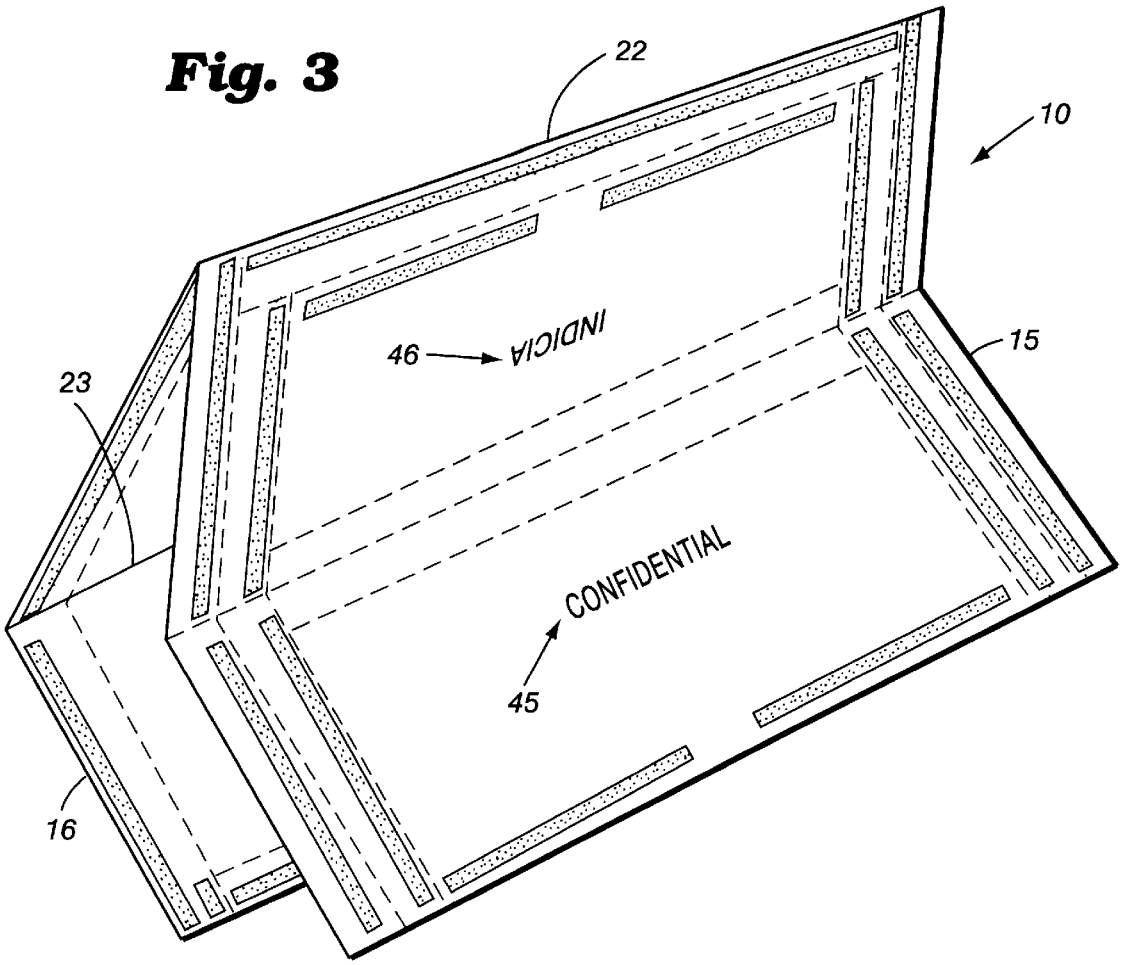
FIG. 3 is a top perspective view illustrating the double-folding of the intermediate of FIGS. 1 and 2.

The intermediate 10 may further comprise a fourth adhesive or cohesive pattern (illustrated as cohesive in the drawings) on at least one of the second face 12 of the third panel 26 adjacent the second end edge 14 thereof, or the first face 11 of the second panel 25 adjacent the second fold line 22. In FIGS. 1 and 2 the fourth cohesive pattern is illustrated by the cohesive strip 50 adjacent and substantially parallel to the end edge 14 (see FIG. 2) and the strip 51 adjacent and substantially parallel to the second fold line 22. When the intermediate 10 is double folded (as illustrated in FIG. 3) about first the fold line 22 and then the fold lines 21, 23, the strips 50, 51 come into contact with each other. This is most easily seen in FIG. 4, in which the intermediate 10 has been folded about the second fold line 22 to bring the second faces 12 of the panels 24, 26; and 25, 27; respectively, into contact with each other. As also most clearly seen in FIG. 4, the panel 26 is of slightly lesser dimension along the side edges 15, 16 then the other panels 24–27 to allow the strips 50, 51 to be brought into contact with each other. Where adhesive is used instead of cohesive this difference in dimension of the third panel 26 is not necessary, but another line of weakness is.

The intermediate 10 also may comprise seventh, eighth, and ninth lines of weakness, illustrated by reference numerals 52, 53, and 54, respectively, in FIGS. 1 and 2. When these lines of weakness 52–54 are provided, they serve to facilitate ready opening of the mailer 55 (see FIG. 5) produced by folding the intermediate 10 about the fold lines 21–23. As seen in FIGS. 1 and 2, the seventh and eighth lines of weakness 52, 53 straddle the second fold line 22, being provided in the panels 25, 27, while the ninth line of weakness 54 is in the panel 26 adjacent the end edge 14. The cohesive strip 50 is between the end edge 14 and the ninth line of weakness 54, while the cohesive strip 51 is between the seventh line of weakness 52 and the second fold line 22.

Figure 4:
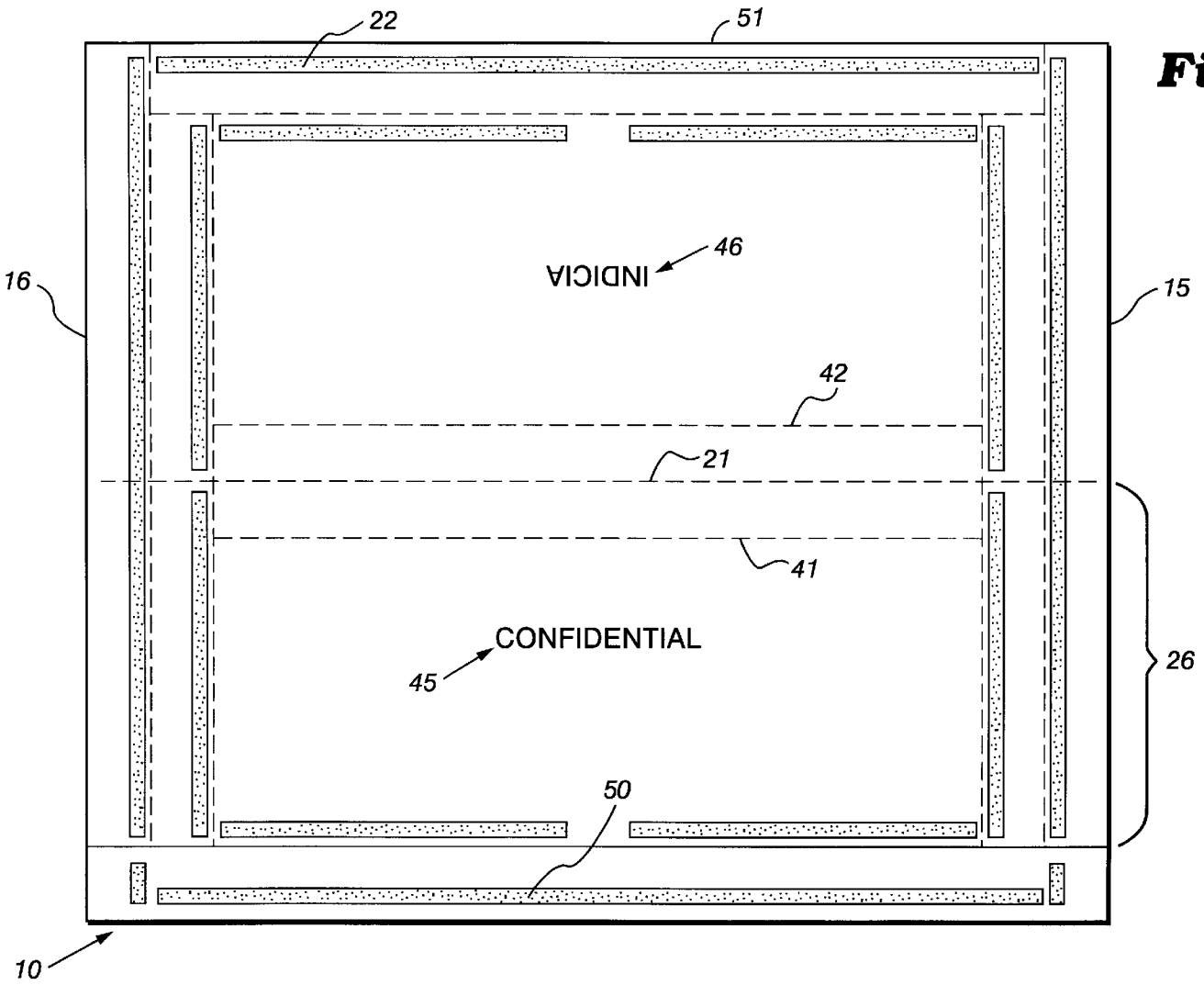
FIG. 4 is a plan view of the intermediate of FIGS. 1 and 2 when folded about just the second fold line thereof.

FIG. 4 illustrates the intermediate 10 when folded about the fold line 22 and just before folding about the fold lines 21, 23. FIG. 3 schematically illustrates folding of the intermediate 10 about the fold lines 21, 23 to form a double-folded mailer 55. Postage is applied on the mailer 55, as illustrated at 56 in FIG. 5, to what was the first face 11 of the third panel 26, and the mailer 55 is sent—after sealing—to the outgoing addressee (47). Once double folding of the intermediate 10 (as schematically illustrated in FIG. 3) has been accomplished, the folded intermediate 10 is passed through conventional pressure seal equipment (such as a Moore SpeediSealer®), which applies about 100–200 pounds per lineal inch of pressure to all of the cohesive strips 28–31, 36–39, 50 and 51, providing the sealed mailer 55.

FIG. 6 illustrates what the confidential insert 40 looks like after the mailer 55 has been opened by removal of the tear-off strips 19, 20, and the tear-off strips defined by the lines of weakness 52–54 and the fold line 22 (illustrated by reference numeral 58 in FIG. 6). The section 59 of the paper sheet 10 illustrated in FIG. 6 is the portion of the panels 26, 27 between the lines of weakness 53, 54, 17, and 18.

One receiving the confidential insert 40 opens it up by detaching the tear-off strips 34, 35, 43–44, revealing the confidential indicia 45, 46 therein as illustrated in FIG. 7. The opened confidential insert 40' illustrated in FIG. 7 is shown with the remaining portions of the panels 24, 25 still sealed by the cohesive strips 38, 39 adjacent the common edge 13, 52. However, as described above, lines of weakness may also be provided adjacent those strips 38, 39 so that the remaining portions of the panels 24, 25 are completely detached from each other.

Figure 5:
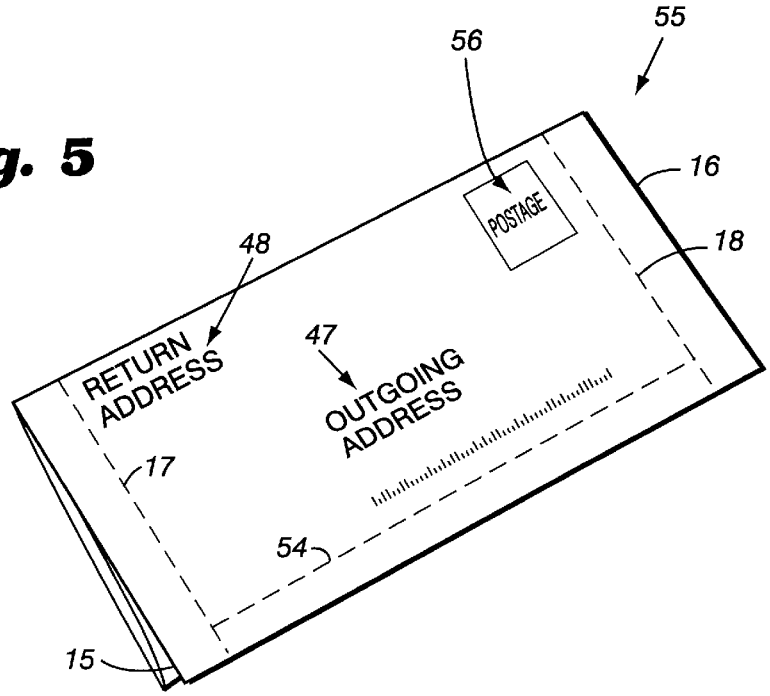
FIG. 5 is a top perspective view of a mailer type business form produced from the intermediate of FIGS. 1 through 4.

The mailer 55 seen in FIG. 5, and in the opened condition to reveal the confidential insert 40, shown at 55' in FIG. 6, consists essentially of the single sheet of paper 10 and has a top ply (panel 26), a bottom ply (panel 27) and two intermediate plies (panels 24, 25), each ply having first and second side edges 15, 16 and first and second end edges (corresponding to the edges of the intermediate 10 panels 24–27, as seen in FIGS. 1 and 2). This is so whether the intermediate 10 of FIGS. 1 and 2 is double folded (as seen in FIGS. 3 and 4), or roll folded (in which case it is first folded about fold line 21, then in the same direction about fold line 22, then in the same direction about fold line 23). If roll folded, the outgoing address 47 is printed on the second face 12 of either of the plies 26, 27.

The intermediate plies (24, 25) of the mailer 55 have facing interior faces, which comprise the first face 11 of each when they are in the intermediate 10 configuration (see FIG. 1). First, second, and third lines of weakness are formed in the plies, as indicated by reference numerals 17, 18 and 54 in FIG. 5, adjacent at least three of the side and end edges and defining the tear-off strips (19, 20, 58). First adhesive or cohesive patterns hold the plies together in the tear-off strips, such as the cohesive strips 28–31, 50, and 51. Second adhesive or cohesive patterns hold the intermediate plies 24, 25 together so as to define a confidential integral insert 40 closed on all edges thereof. The second adhesive or cohesive patterns may comprise the cohesive strips 36–39. Confidential indicia 45, 46 is imaged on at least one of the interior faces of the intermediate plies 24, 25 as seen in FIGS. 1 and 7. Other lines of weakness are formed in the intermediate plies, confidential integral insert 40, to allow ready and tamper-indicating opening of the confidential integral insert 40 to expose the confidential indicia 45, 46. See the lines of weakness 32, 33, 41, 42 in FIG. 6, for example. The outgoing address indicia 47 is imaged on the top ply and is visible from the exterior of the mailer.

Figure 8:
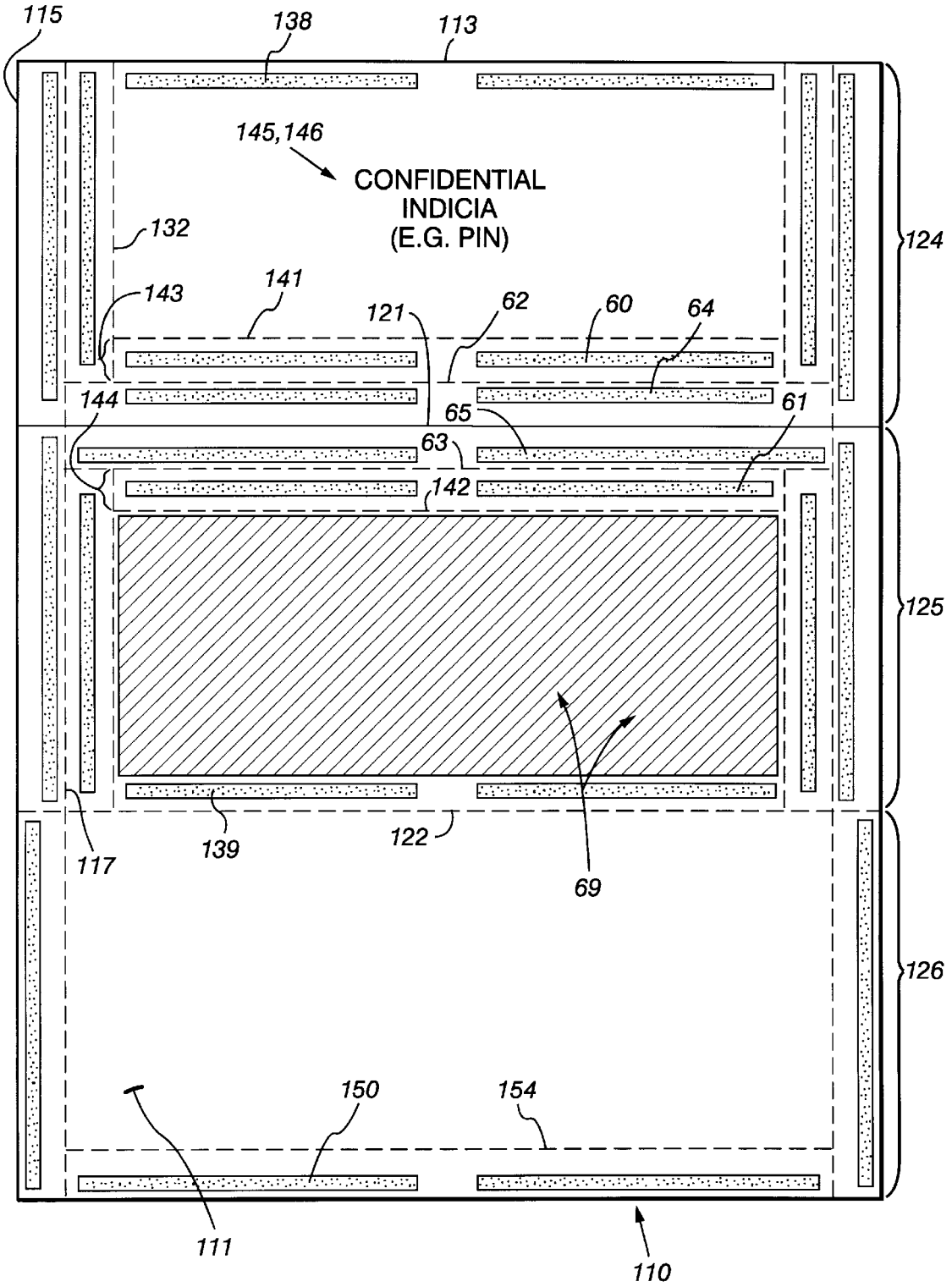
FIG. 8 is a view like that of FIG. 1 of another embodiment of an intermediate according to the invention.
Figure 9:
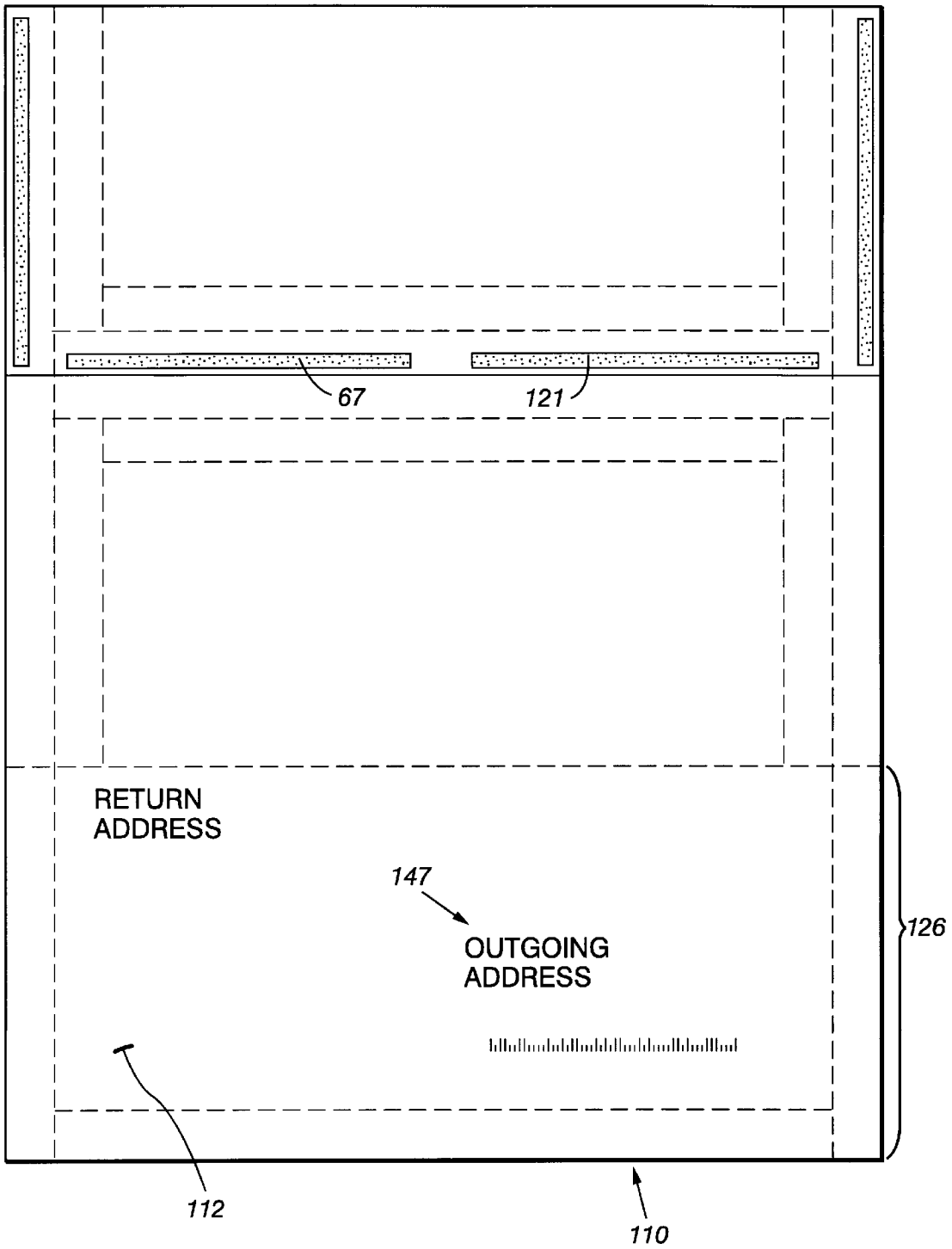
FIG. 9 is a bottom plan view of the intermediate of FIG. 8.

While what is illustrated in FIGS. 1 through 7 comprises the preferred embodiment of an intermediate 10 of the mailer 55 of the invention, a three panel intermediate/three ply mailer may also be provided, for example, the intermediate 110 illustrated in FIGS. 8 and 9. In FIGS. 8 and 9 all of the components comparable to those of FIGS. 1 and 2 are shown by the same reference numeral only preceded by a "1".

The first and second plies 124, 125 in FIGS. 8 and 9 are substantially identical to the plies 24, 25 on the first face 11 thereof, except that in the FIG. 8 embodiment additional optional strips of cohesive 60, 61 are shown in the tear-off strips 143, 144, and instead of the lines of weakness 52, 53 there are the lines of weakness 62, 63, and additional cohesive strips 64, 65 are provided in the tear-off strips defined therebetween and bisected by the first fold line 121. Also in this embodiment the second fold line 122 is a line of weakness, the outgoing address 147 is imaged on the second face 112 of the third panel 126 (see FIG. 9), and the cohesive strip cooperating with the cohesive strip 150—that is the cohesive strip 67 in FIG. 9—is provided on the second face 112 of the first panel 124 adjacent the first fold line 121, as seen in FIG. 9. With that arrangement a mailer is constructed from the intermediate 110 by first folding about the first fold line 121 to bring the faces 111 of the panels 124, 125 into contact, and then the third panel 126 is C-folded about the second fold line 122. Alternatively, by rearranging the strips 150, 67, and by providing the outgoing address indicia 147 on first face 111 of the panel 126, a Z-folded mailer may be provided.

For the three panel intermediate 110 of FIGS. 8 and 9 in order to obtain the same level of security/confidentiality as for the four panel embodiment 10, security screening—illustrated schematically at 69 in FIG. 8—is preferably provided on the first face 111 of one of the panels 124, 125, while the confidential indicia 145, 146 is provided on the first face 111 of the other panel 124, 125.

In the FIGS. 8 and 9 embodiment the intermediate 110 as shown is made from a conventional 8×11 sheet, with the panels 124–126 having substantially the same dimensions.

It will thus be seen that according to the present invention a highly advantageous intermediate for a mailer type business form, and mailer produced therefrom, are provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products and devices.

What is claimed is:

1. An intermediate for a mailer type business form comprising:

a substantially quadrate sheet of paper having first and second faces, substantially parallel first and second end edges, and first and second side edges substantially parallel to each other and substantially perpendicular to said end edges;

first and second lines of weakness formed in said sheet of paper adjacent and substantially parallel to said first and second side edges, respectively, and defining first and second, respectively, tear-off strips;

at least first and second fold lines substantially parallel to said end edges and defining said sheet into at least first, second and third panels, said first panel between said first end edge and first fold line, said second panel between said first and second fold lines, and said third panel on the opposite side of said second fold line from said second panel;

first adhesive or cohesive patterns in said first and second tear-off strips for sealing said panels together when said sheet is folded about said first and second fold lines;

third and fourth lines of weakness, substantially parallel to said first and second lines of weakness, provided only in said first and second panels between said first and second lines of weakness, and defining third and fourth, respectively, tear off strips in only said first and second panels;

second adhesive or cohesive patterns on said first face only in said third and fourth tear-off strips for sealing said first and second panels together when said sheet is folded about said first fold line; and a third adhesive or cohesive pattern provided on said first face in at least one of said first panel adjacent said first end edge and said second panel near said second fold line to cooperate with said second adhesive or cohesive patterns and said first fold line to define, when said first and second panels are folded about said first fold line with said first faces thereof in contact with each other and said second and third adhesive or cohesive patterns sealed, a confidential integral insert closed on all edges thereof.

2. A mailer intermediate as recited in claim 1 further comprising confidential indicia imaged on said first face of at least one of said first and second panels.

3. A mailer intermediate as recited in claim 1 wherein said at least first and second fold lines comprises first, second, and third fold lines; and wherein said at least three panels comprises first, second, third and fourth panels, said third panel between said third fold line and said second end edge, and said fourth panel between said second and third fold lines; and wherein when said panels are folded about said first, second and third fold lines, said first and second panels are between said third and fourth panels.

4. A mailer intermediate as recited in claim 3 wherein said panels are substantially devoid of security screening.

5. A mailer intermediate as recited in claim 3 further comprising outgoing address indicia on said first face of said third panel.

6. A mailer intermediate as recited in claim 1 further comprising outgoing address indicia on said second face of said third panel.

7. A mailer intermediate as recited in claim 3 further comprising a fourth adhesive or cohesive pattern provided on said least one of said second face of said third panel adjacent said second end edge, and said first face of said second panel adjacent said second fold line.

8. A mailer intermediate comprising a substantially quadrate sheet of paper having first and second faces, substantially parallel first and second end edges, and first and second side edges substantially parallel to each other and substantially perpendicular to said end edges;

first and second lines of weakness formed in said sheet of paper adjacent and substantially parallel to said first and second side edges, respectively, and defining first and second, respectively, tear-off strips;

at least first and second fold lines substantially parallel to said end edges and defining said sheet into at least first, second and third panels, said first panel between said first end edge and first fold line, said second panel between said first and second fold lines, and said third panel on the opposite side of said second fold line from said second panel;

first adhesive or cohesive patterns in said first and second tear-off strips for sealing said panels together when said sheet is folded about said first and second fold lines;

third and fourth lines of weakness, substantially parallel to said first and second lines of weakness, provided in said first and second panels between said first and second lines of weakness, and defining third and fourth, respectively, tear off strips;

second adhesive or cohesive patterns on said first face in said third and fourth tear-off strips for sealing said first and second panels together when said sheet is folded about said first fold line;

a third adhesive or cohesive pattern provided on said first face in at least one of said first panel adjacent said first end edge and said second panel near said second fold line to cooperate with said second adhesive or cohesive patterns and said first fold line to define, when said first and second panels are folded about said first fold line with said first faces thereof in contact with each other and said second and third adhesive or cohesive patterns sealed, a confidential integral insert closed on all edges thereof; and fifth and sixth lines of weakness substantially parallel to and adjacent and on opposite sides of said first fold line, extending between said third and fourth lines of weakness, and defining fifth and sixth, respectively, tear off strips.

9. A mailer intermediate as recited in claim 7 further comprising fifth and sixth lines of weakness substantially parallel to and adjacent and on opposite sides of said first fold line, extending between said third and fourth lines of weakness, and defining fifth and sixth, respectively, tear off strips.

10. A mailer intermediate as recited in claim 9 further comprising seventh, eighth and ninth lines of weakness formed in said second, third, and fourth panels, respectively, substantially parallel to said end edges, said seventh and eighth lines of weakness adjacent said second fold line, and said ninth line of weakness adjacent said second end edge; to define seventh, eighth and ninth tear off strips, said fourth adhesive or cohesive provided in at least one of said ninth and seventh tear-off strips.

11. A mailer intermediate as recited in claim 9 wherein said first, second, third and fourth patterns of adhesive or cohesive comprise cooperating strips or spots of pressure activated cohesive.

12. A mailer intermediate as recited in claim 1 wherein said first and second patterns of adhesive or cohesive comprise cooperating strips or spots of pressure activated cohesive.

13. A mailer intermediate as recited in claim 1 wherein said third panel, and at least one of said first and second panels, is substantially devoid of security screening.

14. A mailer intermediate as recited in claim 2 further comprising outgoing address indicia on said third panel.

15. A mailer intermediate as recited in claim 1 wherein said second fold line is a line of weakness.

16. A mailer intermediate as recited in claim 1 wherein said sheet is a standard legal size or A4 size sheet.

17. A mailer intermediate comprising a substantially quadrate sheet of paper having first and second faces, substantially parallel first and second end edges, and first and second side edges substantially parallel to each other and substantially perpendicular to said end edges;

first and second lines of weakness formed in said sheet of paper adjacent and substantially parallel to said first and second side edges, respectively, and defining first and second, respectively, tear-off strips;

at least first and second fold lines substantially parallel to said end edges and defining said sheet into at least first, second and third panels, said first panel between said first end edge and first fold line, said second panel between said first and second fold lines, and said third panel on the opposite side of said second fold line from said second panel;

first adhesive or cohesive patterns in said first and second tear-off strips for sealing said panels together when said sheet is folded about said first and second fold lines;

third and fourth lines of weakness, substantially parallel to said first and second lines of weakness, provided in said first and second panels between said first and second lines of weakness, and defining third and fourth, respectively, tear off strips;

second adhesive or cohesive patterns on said first face in said third and fourth tear-off strips for sealing said first and second panels together when said sheet is folded about said first fold line;

a third adhesive or cohesive pattern provided on said first face in at least one of said first panel adjacent said first end edge and said second panel near said second fold line to cooperate with said second adhesive or cohesive patterns and said first fold line to define, when said first and second panels are folded about said first fold line with said first faces thereof in contact with each other and said second and third adhesive or cohesive patterns sealed, a confidential integral insert closed on all edges thereof; and at least one other pattern of adhesive or cohesive holding said panels together when said sheet is double folded about said second fold line, and then together about said first and third fold lines.

18. A mailer intermediate as recited in claim 3 further comprising at least one other pattern of adhesive or cohesive holding said panels together when roll folded about said first fold line, then said second fold line, and then said third fold line, in the same direction.

19. A mailer type business form made by double folding the intermediate of claim 17, and sealing the adhesive or cohesive patterns thereof.

20. A mailer type business form made by roll folding the intermediate of claim 18, and sealing the adhesive or cohesive patterns thereof.

21. A mailer type business form consisting essentially of a single sheet of paper and having a top ply, bottom ply, and two intermediate plies, each ply with first and second side edges, and first and second end edges, and said intermediate plies including facing interior faces; and further comprising:

first, second, and third lines of weakness formed in said plies adjacent at least three of said side and end edges and defining tear-off strips;

first adhesive or cohesive patterns holding said plies together in said tear-off strips;

second adhesive or cohesive patterns holding said intermediate plies together so as to define a confidential integral insert closed on all edges thereof;

confidential indicia imaged on at least one of said interior faces of said intermediate plies; and other lines of weakness formed in said intermediate plies, confidential integral insert, to allow ready and tamper-indicating opening of said confidential integral insert to expose said confidential indicia.

22. A mailer type business form as recited in claim 21 further comprising outgoing address indicia imaged on said top ply and visible from the exterior of said mailer.

23. A mailer type business form as recited in claim 21 wherein said first and second patterns of adhesive or cohesive comprise pressure activated cohesive.

* * * * *